US005946831A

United States Patent [19]

Wilson, Sr. et al.

[11] Patent Number: 5,946,831

[45] Date of Patent: Sep. 7, 1999

[54] AMPHIBIOUS SCRAPER

[75] Inventors: John M. Wilson, Sr.; Dean R. Wilson, both of Marrero, La.

[73] Assignee: Wilco Marsh Buggies & Draglines, Inc., Marrero, La.

[21] Appl. No.: 08/708,549

[22] Filed: Sep. 5, 1996

Related U.S. Application Data

[60] Provisional application No. 60/018,761, May 31, 1996.

[51] Int. Cl.[6] ..... E02F 3/64

[52] U.S. Cl. ..... 37/412; 172/799.5

[58] Field of Search ..... 405/190; 37/341, 37/412; 172/799.5, 781; 152/209 WT, 533; 180/209; 301/5.1, 52

[56] References Cited

U.S. PATENT DOCUMENTS

| | | | |
|---|---|---|---|
| 2,964,861 | 12/1960 | Corsini | 37/412 |
| 3,110,972 | 11/1963 | Waite | 37/412 |
| 3,445,946 | 5/1969 | Striggow | 37/412 |
| 3,776,318 | 12/1973 | Layton | 172/799.5 |
| 3,890,010 | 6/1975 | Dove, Jr. et al. | 301/52 |
| 4,248,287 | 2/1981 | Christman | 152/533 |
| 4,253,512 | 3/1981 | Yoshioka et al. | 152/209 WT |

OTHER PUBLICATIONS

Undated Document entitled "Wilco Marsh Buggies, Inc. Experts in De–Watering and Disposal Area Construction".

*Primary Examiner*—Tamara Graysay
*Assistant Examiner*—Frederick L. Lagman
*Attorney, Agent, or Firm*—Shawn Hunter; Conley, Rose & Tayon, P.C.

[57] ABSTRACT

Apparatus and methods are described for modification of a scraper, or similar heavy equipment, for operation in wet or swampy areas including dredge disposal areas. A floatation tire assembly is described which is removably affixable to the scraper to give the scraper the amphibious capability to operate in the wet, swampy environment.

14 Claims, 4 Drawing Sheets

AMPHIBIOUS SCRAPER

This application claims benefit of Provisional Application Ser. No. 60/018,761 filed May 31, 1996.

BACKGROUND OF THE INVENTION

1. Field of the Invention

The present invention relates generally to earth-moving vehicles and their use in particularly wet or swampy environments. In particular, aspects of the invention relate to scrapers and similar equipment.

2. Description of Related Art

Scrapers are used for removal and transportation of large amounts of earth. They are typically wheeled and may be towed or self-propelled. A scraper includes a pan which may be lowered to be brought into contact with the earth or raised to be brought out of contact with the ground. The scraper pan contains a bin or receptacle for the holding of earth. The pan features an opening located proximate the ground surface which may be selectively opened and closed. A scraper blade is incorporated into the pan near the opening. When the pan is lowered and the opening opened, the blade scrapes earth into the bin of the pan as the scraper is moved along the surface.

Although conventional scrapers operate reliably on terra firma, they are not generally suitable in areas which are excessively wet or swampy as their weight, particularly when loaded with earth, causes the scraper to become mired.

A particularly difficult operating environment, for scrapers and other vehicles, is the dredge disposal area. In these areas, the spoil from aquatic dredging is placed. Due to the presence of heavy metals and other toxic substances, this spoil is treated as hazardous waste and may be placed in designated disposal sites. Once the spoil is removed from a river bottom or other aquatic site, it tends to expand because it is no longer under pressure. As the spoil expands, it retains significant amounts of water. Due to retained water, the spoil is extremely marshy. Land vehicles are unable to work in a dredge disposal area unaided by placing matting over the spoil or by similar measures. Even with the use of matting, beholds often sink into the spoil and can be recovered only at great cost.

Maintaining a dredge disposal area requires cutting of ditches to drain water from the spoil and then removal of dried soil from the pit. Dredge disposal area maintenance procedures and associated equipment are described in greater detail in U.S. patent application Ser. No. 08/708,648, entitled "Containment Area Process", still pending, and "U.S. patent application Ser. No. 08/706,614 entitled "Positive Drive Winch", still pending, each assigned to the assignee of the present invention and incorporated herein by reference. If capable of operating in dredge disposal areas, scrapers would be ideal pieces of equipment to accomplish removal of the dried spoil.

SUMMARY OF THE INVENTION

Apparatus and methods are described for modification of a scraper, or similar heavy equipment, for operation in wet or swampy areas including dredge disposal areas. A floatation tire assembly is described which is removably affixable to the scraper to give the scraper the amphibious capability to operate in the wet, swampy environment.

DETAILED DESCRIPTION OF THE PREFERRED EMBODIMENTS

Figure 1:
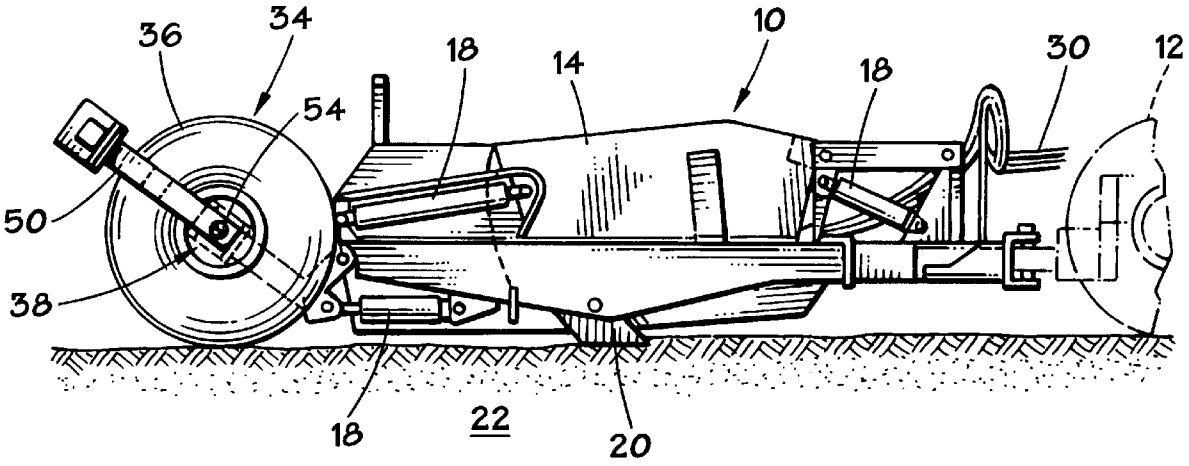
FIG. 1 is a side view of an exemplary towed amphibious scraper with an affixed flotation tire assembly in accordance with the present invention.
Figure 2:
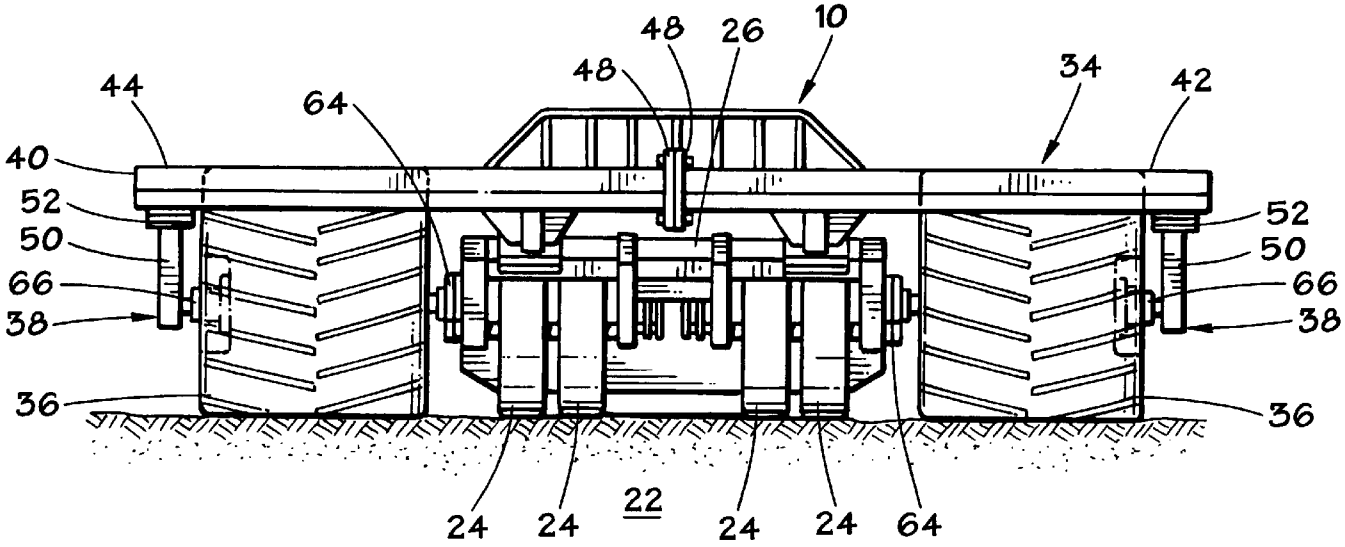
FIG. 2 is a rear view of the scraper of FIG. 1.
Figure 3:
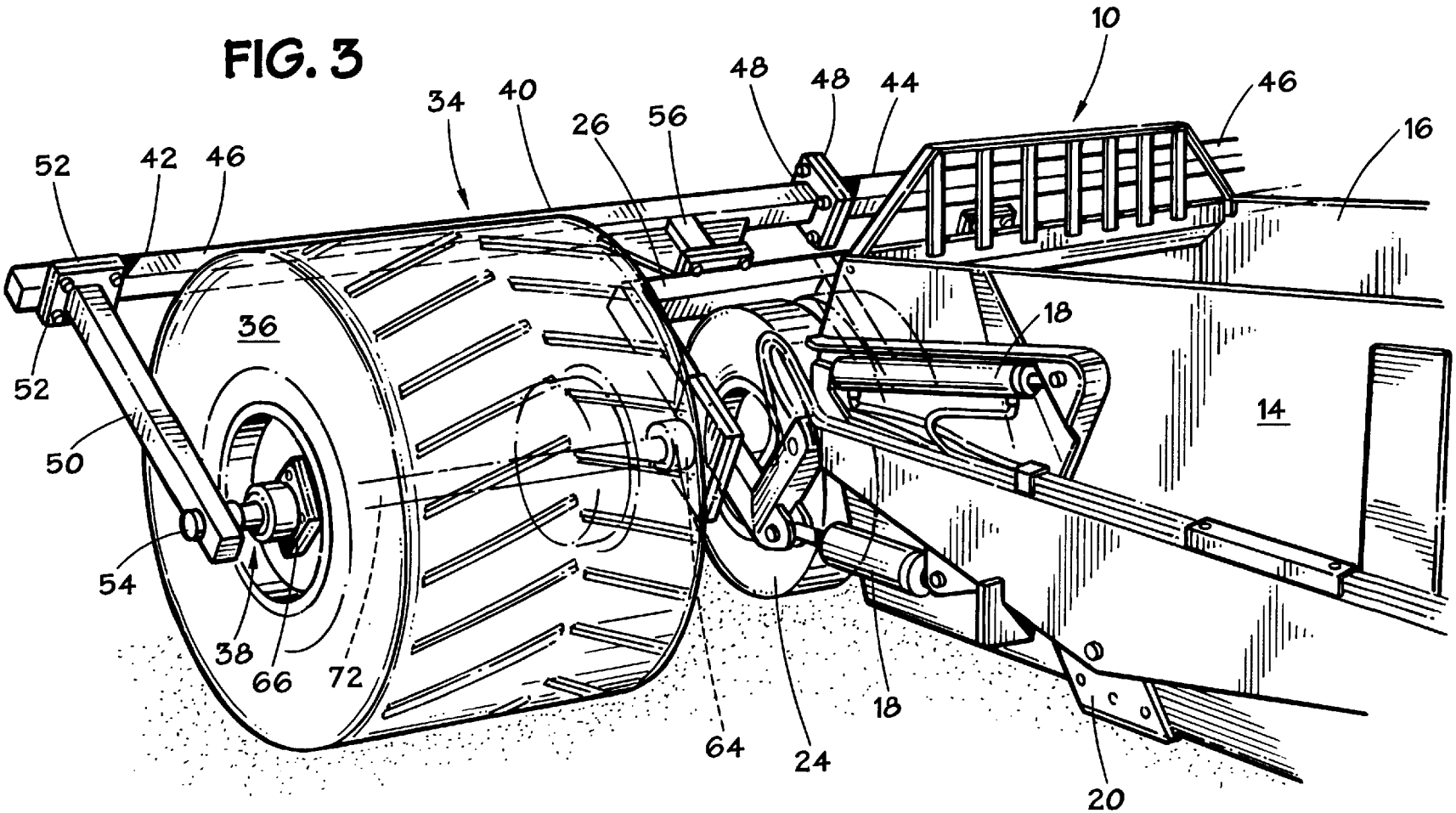
FIG. 3 is an isometric view of a portion of the scraper of FIGS. 1–2.

Referring now to FIGS. 1–4, an exemplary amphibious scraper 10 is shown of the type which is towed behind a prime mover 12 in operation. A suitable prime mover 12 is a Rolligon, available from Rolligon Corporation, 10635 Brighton Lane, Stafford, Tex. 77477, (713) 495-1140. The scraper 10 includes a pan 14 with an interior bin 16 (best seen in FIG. 3) for storage of earth. One type of conventional commercial pan useful for modification in accordance with the present invention is an 11 cubic yard scraper pan manufactured by Rome Mfg. Co. of Cedart Town, Georgia. Hydraulic assemblies 18 can selectively raise or lower the pan 14. The lower opening (not shown) includes a forwardly-directed blade 20 which comes into contact with the ground surface 22 when the pan 14 is lowered. The opening is opened for receipt of earth when the pan 14 is lowered and is moved into a closed position when the pan 14 is raised. Such opening and closing operations are, of course, well known and need not be described in detail here.

The scraper 10 features a conventional wheel assembly with land-capable wheels 24. A cross-piece 26 extends across the upper portion of the conventional wheels 24. Use of conventional wheel assemblies with such components is well known.

Figure 4:
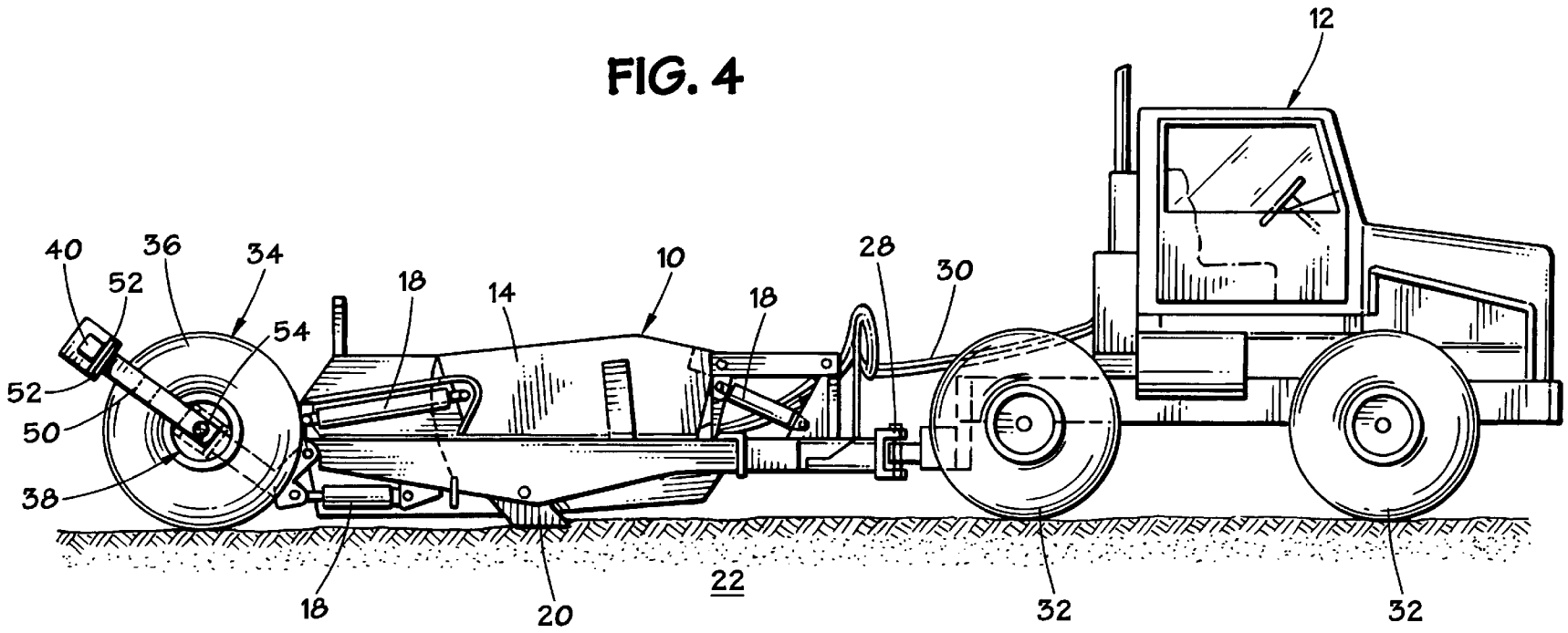
FIG. 4 depicts the scraper of FIGS. 1–3 affixed for towing behind a prime mover.

As FIG. 4 illustrates, the scraper 10 also includes a towing hitch 28 by which it can be affixed to the prime mover 12 for towing. Hydraulic lines 30 extend from the prime mover 12 to the scraper 10 to supply hydraulic fluid to assemblies 18. It is noted that the prime mover 12 is preferably equipped with flotation tires 32.

A demountable flotation tire assembly 34 is shown in place on the scraper 10. The flotation tire assembly 34 includes a pair of surface engaging flotation tires 36. The flotation tires 36 are of a low pressure, balloon tire variety known in the art. The flotation tires 36 are affixed to the scraper 10 by an axle extension assembly 38 and a support bracket assembly 40.

Figure 5:
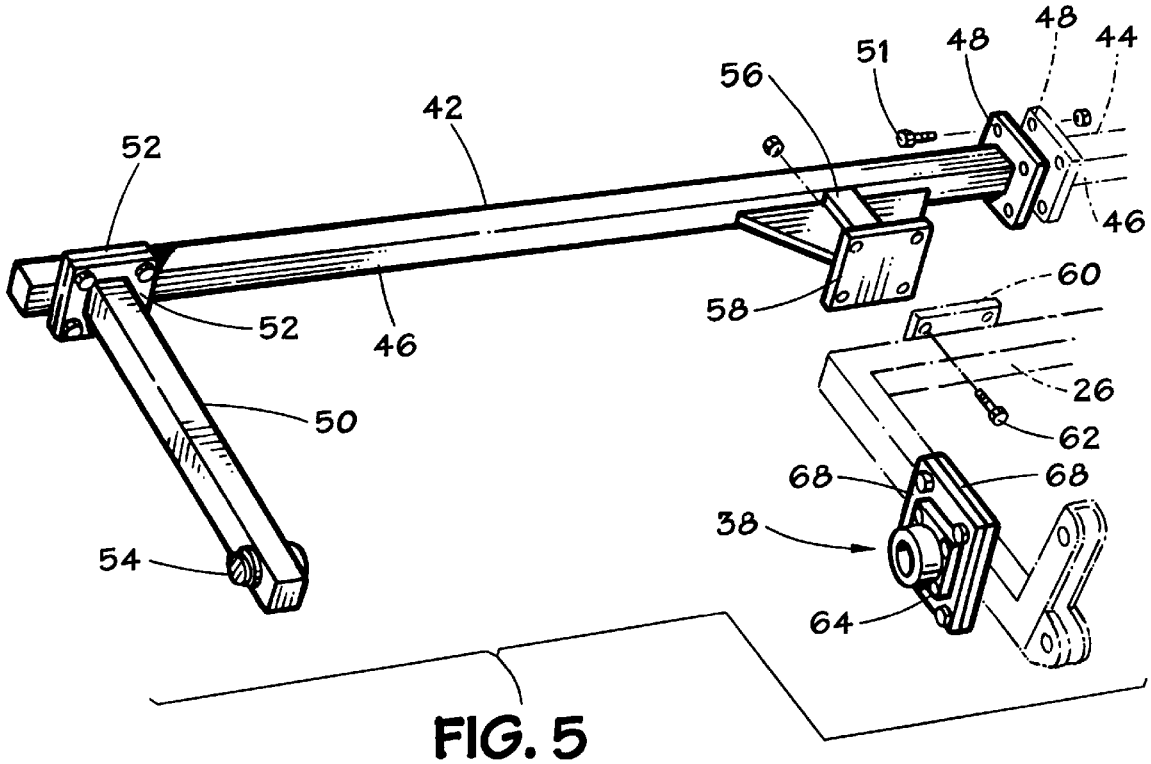
FIG. 5 is an exploded view showing an exemplary support bracket assembly.

The support bracket assembly 40 helps maintain affixation of the flotation tires 36 to the scraper 10 and is preferably fashioned from a pair of removable L-shaped bracket sections 42, 44, the construction of which is best seen in FIG. 5. Each bracket section 42, 44 includes a horizontal member 46 having a connecting bolt plate 48 welded or otherwise fixedly connected to the inboard end of the support member 46. The horizontal members 46 are also each affixed at their opposite ends to a lateral brace member 50 which extends from the horizontal member 46 to the axle extension assembly 38 for each flotation tires 36. The horizontal members 46 and lateral members 50 are preferably affixed together using are pair of connecting bolt plates 52 which are similar to the bolt plates 48 described previously. At its opposite end, the lateral members 50 have a horizontally disposed shaft 54 disposed therethrough. The two bracket sections 42, 44 are reversably connectable by affixing the bolt plates 48 of each section using connectors such as suitable bolt and nut assemblies 51 (see FIG. 5). When the bracket assembly 40 is fashioned from a number of removable bracket sections, such as bracket halves 42, 44, the entire bracket assembly 40 may be readily removed from the scraper 10 so that the scraper 10 and the components of bracket assembly 40 may be transported on a low boy or other transporter without exceeding the roadway width. The bracket assembly 40 may also be removed when the flotation tire assembly 34 is unnecessary, such as when the scraper is operating in areas which are not swampy or marshy.

The horizontal members 46 each include a lateral connection piece 56 through which the support bracket assembly 40 is fixedly connected to the cross-piece 26 of scraper 10. Preferably, another pair of connecting bolt plates 58, 60 are used to affix the connection piece 56 to the cross-piece 26. One plate 58 is welded to the connection piece 56 while the other plate 60 is welded to the cross piece 26. Bolt and nut connectors 62 are used to interconnect the two plates 58, 60.

Each of the two flotation tires 36 is maintained in rolling engagement with the surface by an axle extension assembly 38. The axle extension assemblies 38 are each made up of two portions: an inner bearing assembly 64 and an outer bearing assembly 66. The inner and outer bearing assemblies 64, 66 are similar to each other in construction. Each functions to help maintain the flotation tires in alignment with the scraper 10 for rotation and surface engagement.

Figure 6:
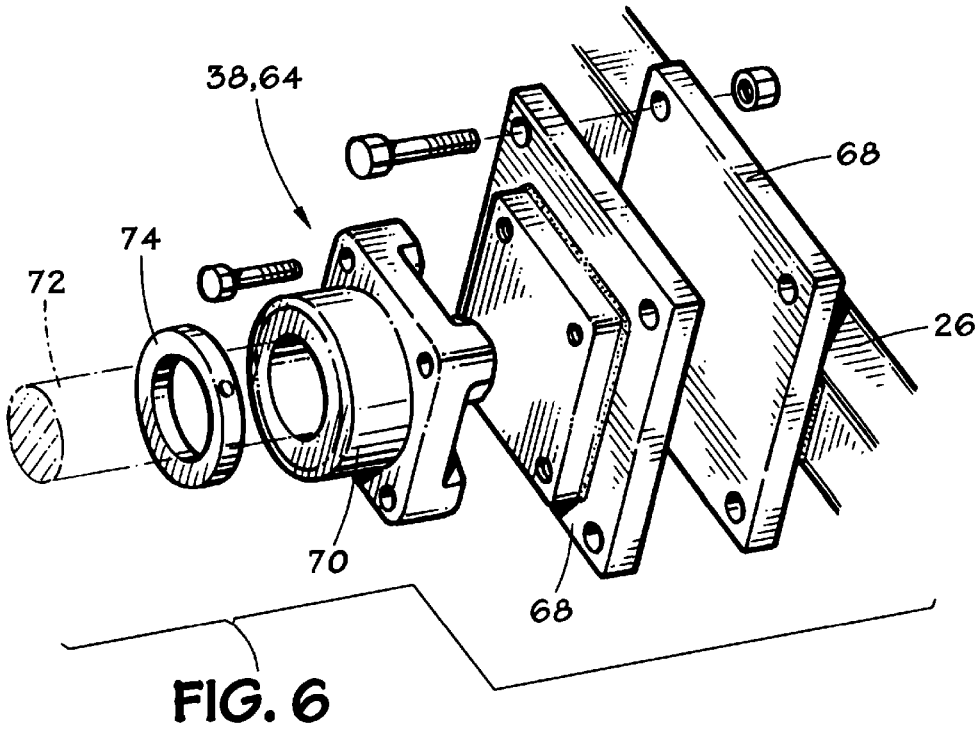
FIG. 6 is a detail depicting an exemplary bearing mount assembly.

The inner bearing assemblies 64 are affixed to the cross-piece 26 (as shown in FIGS. 5 and 6) by welding or other means of creating a secure connection. Details of the inner bearing assemblies 64 are best understood by reference to the exploded view of FIG. 6. Bearings for use in bearing assemblies of this type may be obtained from numerous commercial bearing vendors including Rexnord Corporation and Motion Industries. The Rex bearing from Rexnord Corporation is an example of a suitable bearing for this application. A pair of connecting bolt plates 68 are used to affix the bearing assembly 64 to the cross-piece 26 in the manner described for previous plate arrangements. An axle bearing 70 is then secured to the outermost bolt plate 68. A collar 74 is used to secure an axle shaft 72 within the bearing 70. In a similar manner, the outer bearing assembly 66 is secured to the outboard shaft 54.

In operation, the scraper 10 is suitable for collecting earth or spoil in marshy areas in which a scraper having only conventional tires would sink. The flotation tires 36 permit the scraper 10 to be substantially buoyant so as not to sink into a marshy surface and become mired.

While preferred embodiments of the invention have been shown and described, modifications thereof can be made by one skilled in the art without departing from the spirit of the invention. For example, the flotation tire assembly might be affixed to portions of the scraper other than the cross-bar 26. Therefore, it is intended that the scope of the invention be limited only to the claims appended hereto and legal equivalents thereof.

What is claimed is:

1. An amphibious scraper towable by a prime mover and capable of operating in wet environments, comprising:

a scraper having a first end adapted for attachment to the prime mover and a second end having at least one land-capable wheel for operation on land surfaces, said scraper having a pan;

a surface engaging flotation tire removably mounted to the second end of the scraper adjacent to the land-capable wheel to permit the scraper pan to be buoyant on wet surfaces to permit the scraper to operate in wet environments;

said land-capable wheel and flotation tire being hydraulically connected to said scraper pan for selectively raising and lowering said scraper pan with respect to said land-capable wheel and flotation tire.

2. The amphibious scraper of claim 1 further comprising a support bracket assembly removably mounting the flotation tire to the scraper.

3. The amphibious scraper of claim 1 further comprising an assembly which extends from an axle of the land-capable wheel and attaches the flotation tire to the scraper to maintain the flotation tire in alignment with the scraper for rotation and surface engagement.

4. A scraper flotation tire assembly for removable affixation to a scraper having land-capable wheels, the assembly comprising:

a surface engaging flotation tire; and a support assembly for removably affixing the flotation tire to a scraper to permit the scraper to be buoyant for operation in wet environments, the support assembly including a support bracket and at least one connector selectively mounting the flotation tire outside of and adjacent to the land-capable wheels whereby the land-capable wheels support the scraper on land surfaces and the flotation tire supports the scraper on marshy surfaces.

5. The scraper flotation tire assembly of claim 4 wherein the support assembly includes an axle extension assembly.

6. The scraper flotation tire assembly of claim 4 wherein the the support bracket supports the flotation tire outside one of the land-capable wheels.

7. A method of modifying a scraper for operation in amphibious environments, comprising:

affixing an amphibious tire assembly to the scraper to make the scraper substantially buoyant;

operating said scraper in an amphibious environment to collect spoil into an interior bin of the scraper; and removing said tire assembly for transportation of the scraper upon a roadway.

8. The method of claim 7 wherein the step of affixing the amphibious tire to the scraper comprises connecting an axle extension assembly to a portion of the scraper, the axle extension assembly including an axle adapted to carry a flotation tire for rotation and surface engagement.

9. The method of claim 8 further comprising the step of connecting a flotation tire support bracket to the scraper which helps maintain affixation of the flotation tire to the scraper.

10. An amphibious scraper capable of operating in wet environments, comprising:

a. a scraper pan having an interior bin for storage;

b. a first wheel assembly comprising:

at least one land-capable wheel;

a cross piece which extends across an upper portion of the land-capable wheel;

c. a second wheel assembly comprising:

at least one flotation tire; and a support bracket assembly removably affixed to the cross piece.

11. The amphibious scraper of claim 10 wherein the support bracket assembly comprises a pair of removable, generally L-shaped bracket sections.

12. The amphibious scraper of claim 11 further comprising an axle extension assembly to maintain the flotation tire in rolling engagement with the surface, the axle extension assembly comprising:

a. An inner bearing assembly affixing the flotation tire to an axle end; and b. an outer bearing assembly affixing the flotation tire to an axle end.

13. An amphibious scraper assembly capable of operating in wet environments, the assembly comprising:

a. a prime mover mounted upon flotation tires;

b. an amphibious scraper, towed by the prime mover, the amphibious scraper being capable of operating in wet environments and comprising:

1) a scraper pan having an interior bin for storage and a blade for contacting a ground surface;

2) a first wheel assembly comprising:

at least one land-capable wheel;

a cross piece which extends across an upper portion of the land-capable wheel;

3) a second wheel assembly comprising:

at least one flotation tire; and a support bracket assembly removably affixed to the cross piece.

14. The amphibious scraper assembly of claim 13 wherein the second wheel assembly is selectively demountable, the support bracket assembly further comprising:

a. a pair of generally L-shaped bracket sections which are reversibly connectable to one another;

b. an outer bearing assembly carried on each bracket section; and c. means for affixing each bracket section to the cross piece.

* * * * *